US007610657B2

(12) United States Patent
Doswell et al.

(10) Patent No.: US 7,610,657 B2
(45) Date of Patent: Nov. 3, 2009

(54) HINGE

(75) Inventors: Wayne Doswell, Richmond Hill (CA); Bradley F. Patzer, Barrie (CA); David W. Shaw, Richmond Hill (CA); Joaquin Hung, Markham (CA)

(73) Assignee: Ventra Group, Inc., Ontario (CA)

( * ) Notice: Subject to any disclaimer, the term of this patent is extended or adjusted under 35 U.S.C. 154(b) by 470 days.

(21) Appl. No.: 11/564,383

(22) Filed: Nov. 29, 2006

(65) Prior Publication Data

US 2007/0277347 A1 Dec. 6, 2007

Related U.S. Application Data

(60) Provisional application No. 60/809,851, filed on Jun. 1, 2006.

(51) Int. Cl.
*E05D 11/10* (2006.01)

(52) U.S. Cl. ..... 16/334; 16/335; 16/344

(58) Field of Classification Search ..... 16/334, 16/333, 335, 319, 374, 375, 255, 286, 86 C, 16/86 B; 292/262, 265, 266, 278, 267, DIG. 15, 292/DIG. 17; 296/146.11, 146.12
See application file for complete search history.

(56) References Cited

U.S. PATENT DOCUMENTS 2,992,451 A * 7/1961 Schonitzer et al. ..... 16/327
4,090,273 A * 5/1978 Hurst, Jr. ..... 16/333
4,446,596 A 5/1984 Arlauskas
4,672,715 A 6/1987 Beckwith
5,511,444 A 4/1996 Clausen
5,570,498 A 11/1996 Hipkiss
5,867,869 A 2/1999 Garrett
5,926,917 A 7/1999 Gantz
6,105,208 A * 8/2000 Westerdale et al. ..... 16/334
6,591,452 B2 7/2003 Jacquin
6,607,236 B2 8/2003 Mooy
6,681,448 B2 1/2004 Liang
6,687,953 B1 2/2004 Liang
6,901,630 B2 6/2005 Liang (Continued)

*Primary Examiner*—Chuck Y. Mah
(74) *Attorney, Agent, or Firm*—Pillsbury Winthrop Shaw Pittman LLP

(57) ABSTRACT

The present invention provides a hinge for connecting a panel to a body for movement between open and closed positions. The hinge comprises a first bracket constructed to be mounted to one of the body and the panel in an installed position of the hinge, and a second bracket constructed to be mounted to the other of the body and the panel in the installed position of the hinge. At least one hinge pin pivotally connects the first and second brackets. An engaging member is provided on the first bracket, and a check arm is movably connected to the second bracket. The check arm has an engaging surface with at least one detent. The engaging surface is engaged with the engaging member. A spring seat is pivotally mounted to the hinge pin, and a spring has one end engaging the spring seat and the other end engaging the check arm so as to bias the check arm into engagement with the engaging member. As the first and second brackets pivot relative to one another the engaging member and check arm move relative to one another with the spring biasing the check arm into engagement with the engaging member, and the spring seat pivots about the at least one hinge pin to accommodate a change in orientation between the check arm and the second bracket.

36 Claims, 2 Drawing Sheets

U.S. PATENT DOCUMENTS

| | | | | |
|---|---|---|---|---|
| 6,901,634 | B2 | 6/2005 | Shaw | |
| 6,938,303 | B2 * | 9/2005 | Watson et al. | 16/334 |
| 2002/0059692 | A1 * | 5/2002 | Jacquin | 16/381 |
| 2004/0020014 | A1 * | 2/2004 | Linnenbrink et al. | 16/344 |
| 2006/0208406 | A2 | 9/2006 | Al-Dahhan | |

* cited by examiner

HINGE

This application claims priority to U.S. Provisional Application Ser. No. 60/809,851, filed Jun. 1, 2006, the entirety of which is incorporated herein by reference.

FIELD OF THE INVENTION

The present invention relates to a hinge.

BACKGROUND OF THE INVENTION

U.S. Pat. Nos. 4,446,596; 4,672,715; 5,570,498; and 6,901,634 are representative of vehicle body door hinge constructions. Generally, a first bracket on the vehicle body is hingedly connected to a second bracket on vehicle door for movement of the vehicle door between open and closed positions.

As shown in U.S. Pat. No. 4,672,715, for example, a coil spring is positioned between a check arm and the second bracket to bias the check arm into engagement with an engagement member on the first bracket. Each end of the spring is seated in essentially a fixed orientation with the check arm and the second bracket, respectively. A problem, however, is that the coil spring is subject to lateral bending as the check arm moves with respect to the second bracket causing the spring to curve in the direction the hinge pivots. This increases complex stresses and fatigue in the spring, thereby reducing spring life.

The present invention endeavors to provide an improved hinge.

SUMMARY OF THE INVENTION

The present invention provides a hinge for connecting a panel to a body for movement between open and closed positions. The hinge comprises a first bracket constructed to be mounted to one of the body and the panel in an installed position of the hinge, and a second bracket constructed to be mounted to the other of the body and the panel in the installed position of the hinge. At least one hinge pin pivotally connects the first and second brackets. An engaging member is provided on the first bracket, and a check arm is movably connected to the second bracket. The check arm has an engaging surface with at least one detent. The engaging surface is engaged with the engaging member. A spring seat is pivotally mounted to the hinge pin, and a spring has one end engaging the spring seat and the other end engaging the check arm so as to bias the check arm into engagement with the engaging member. As the first and second brackets pivot relative to one another the engaging member and check arm move relative to one another with the spring biasing the check arm into engagement with the engaging member, and the spring seat pivots about the at least one hinge pin to accommodate a change in orientation between the check arm and the second bracket.

Another aspect of the invention relates to a vehicle having a body, a panel, and the above-described hinge for connecting the panel to the body.

Other objects, features, and advantages of the present invention will become apparent from the following detailed description, the accompanying drawings, and the appended claims.

DETAILED DESCRIPTION OF THE ILLUSTRATED EMBODIMENT(S)

Figure 1:
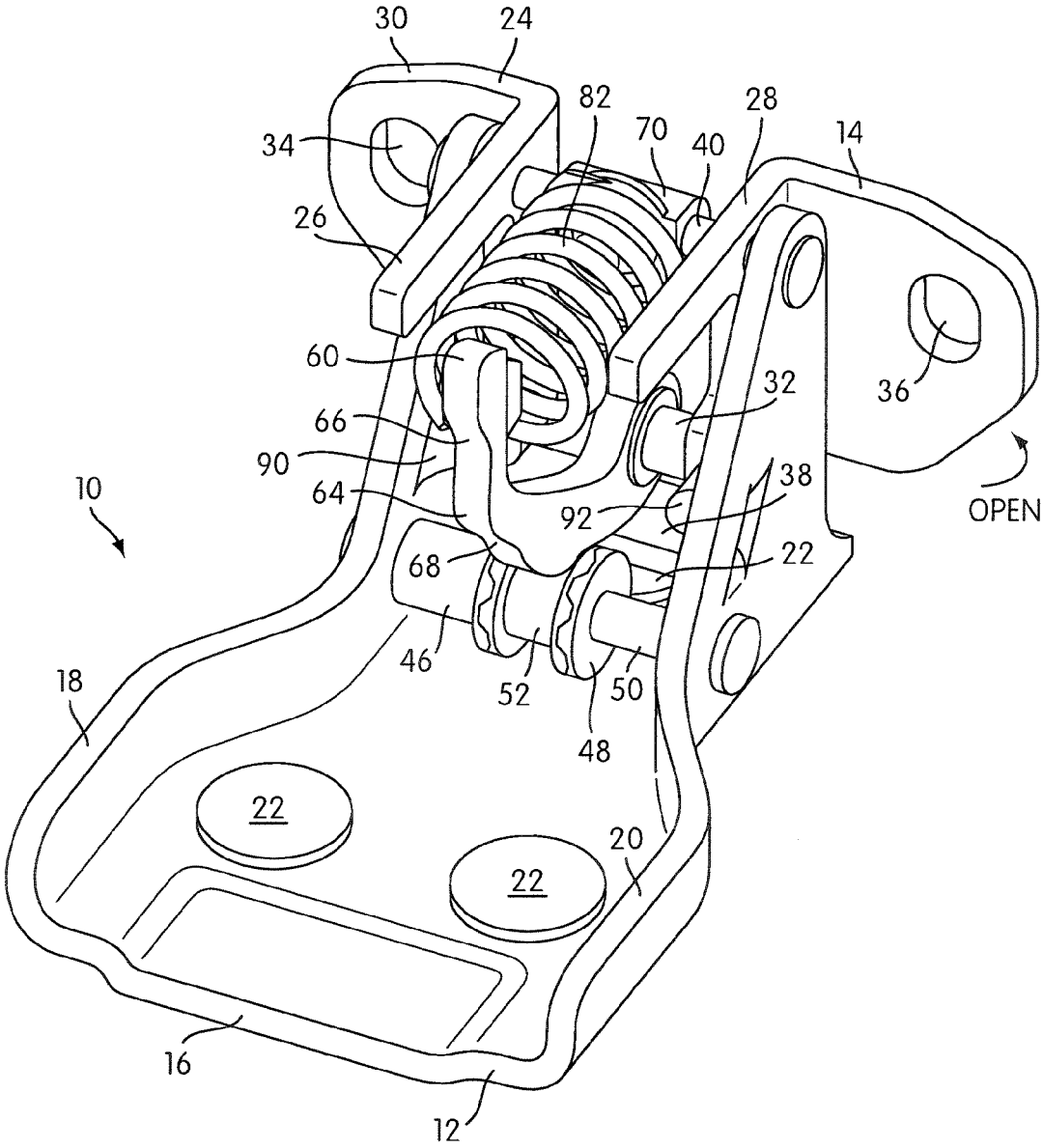
FIG. 1 illustrates a perspective view of a hinge constructed in accordance with an embodiment of the invention, the hinge being in the position corresponding to the closed position of a door panel.

FIG. 1 illustrates a hinge 10 constructed in accordance with one embodiment of the present invention. This hinge 10 is provided only as an example to illustrate one way for constructing the invention, and should not be regarded as limiting. The hinge 10 is designed to connect a panel to a body for movement between open and closed positions. In the illustrated embodiment, the hinge is designed for use in a motor vehicle (i.e., a car, truck, boat, etc.), and may be used to connect a movable panel to the vehicle body. For example, the preferred application for the illustrated hinge 10 is hingedly connecting a vehicle door to the vehicle body for movement between open and closed positions. The illustrated hinge 10 may be used in tandem with another hinge, and that other hinge may have the same or a different construction than hinge 10. For convenience in putting the illustrated embodiment in context, reference will be made to the hinge's use in supporting a door panel of a motor vehicle, but it will be understood that the hinge 10 may have other applications. The illustrated hinge 10 is of the integrated check type, meaning that the checking device is provided as part of the hinge 10, and not as an entirely separate device from the hinge 10.

The hinge 10 comprises a body bracket 12 and a door bracket 14. The term bracket is a generic structural term that refers to any structure that attaches the hinge 10 to an object, and the illustrated brackets 12, 14 should not be regarded as limiting. The body bracket 12 is constructed to be mounted to the vehicle body, and the door bracket 14 is constructed to be mounted to the vehicle door panel. That is, when the hinge 10 is in its installed position, the body bracket 12 is mounted to the vehicle body and the door bracket 14 is mounted to the vehicle door panel. The term installed position refers to the normal use position of the hinge wherein it hingedly connects the panel to the body.

The body bracket 12 is stamped from a piece of sheet metal, but may be formed in any suitable manner. The illustrated body bracket 12 has a base 16 and a pair of walls 18, 20 extending generally perpendicularly from the base 16. A plurality of holes (in the illustrated embodiment there are three) are formed through the base 16 and receive fasteners 22 for securely attaching the bracket 12 to a vehicle body. Any type of fasteners may be used, such as rivets, screws, nuts/bolts, etc., and any number of holes may be provided for receiving such fasteners. Also, instead of a mechanical fastener, the body bracket 12 may be attached to the vehicle body by welding.

The base 16 is somewhat flared, and is narrower at the end where the hinged connection is established, and wider at the opposite end. Also, the walls 18, 20 are higher at the narrower end of the base 16, and have a generally triangular shape as seen in FIG. 1. At the wider end of the base 16, the walls 18, 20 transition down from the higher triangular shape to a lip that provides additional structural rigidity to the base 16 in that area.

The illustrated body bracket 12 is provided solely as an example, and should not be regarded as limiting. To the contrary, the body bracket 12 may have any construction or configuration.

The door bracket 14 is stamped from a piece of sheet metal, but may be formed in any suitable manner. The illustrated door bracket 14 has a base 24 including a pair of flanges 30, 32, and a pair of walls 26, 28 extending generally perpendicularly from the base 24. A plurality of holes 34, 36 (in the illustrated embodiment there are two) are formed through the flanges 30, 32 of the base 24 and receive fasteners (not shown) for securely attaching the bracket 14 to a vehicle door panel. Any type of fasteners may be used, such as rivets, screws, nuts/bolts, etc., and any number of holes may be provided for receiving such fasteners. Also, instead of a mechanical fastener, the door bracket 14 may be attached to the vehicle door panel by welding. An optional strap 38 also connects the inner ends of the walls 26, 28 to provide additional structural rigidity. The strap 38 in some configurations may also serve as the sole structure connecting the lateral sides of the bracket 14.

The illustrated door bracket 14 is provided solely as an example, and should not be regarded as limiting. To the contrary, the door bracket 14 may have any construction or configuration.

The walls 26, 28 of the door bracket 14 are spaced apart so as to nest within the walls 18, 20 of the body bracket 12. Holes in the walls 18, 20, 26, 28 are aligned and receive a hinge pin 40 to pivotally connect the brackets 12, 14 to one another for opening and closing movements. To secure the hinge pin 40, one end may have a wide head (as shown at 42 in FIG. 2), and the other end may be riveted or flattened to create an opposing wide head 44 after insertion through the holes. However, any suitable connection may be used, and the illustrated hinge pin 40 should not be regarded as limiting. Also, in more complex embodiments it is possible for multiple hinge pins to be used, such as a smaller hinge pin for connecting walls 18 and 26, and a smaller hinge pin for connecting walls 20 and 28. Thus, the invention should not be regarded as limited to the illustrated single hinge pin embodiment. However, a single hinge pin is preferred for lower part costs, reduced assembly complexity, and providing a mounting point for spring seat 70 described below.

The hinge 10 further comprises an engaging member 46 provided on the body bracket 12. The engaging member comprises a roller 48 rotatably mounted to the body bracket 12 about a roller axis parallel to the hinge pin 40 and the check arm axis, which is discussed below. The illustrated roller 48 rotates about a shaft 50 extending between the walls of the brackets 12, 14 along the roller axis, and may have any construction or configuration. For example, reference may be made to U.S. Pat. No. 6,901,634, the entirety of which is incorporated herein by reference. The shaft 50 may be mounted in the same manner as hinge pin 40, or in any other suitable manner. The roller 48 may be received on the shaft 50 in any suitable manner. Preferably but not necessarily, the roller 48 has an annular groove 52 for receiving the check arm 60, to be described below.

Alternatively, the engaging member 46 could be a fixed structure, such as a fixed shaft or any other structure suitable for engaging the check arm 60. Thus, the engaging member 46 illustrated and described should not be regarded as limiting, and any structure that engages the check arm 60 for controlling hinge movement may be used within the scope of the present invention.

The check arm 60 is movably connected to the door bracket 14. Preferably, the check arm 60 is pivotally connected to the door bracket 14 about a check arm axis parallel to the hinge pin 40 and the roller axis, and extends between the walls of the hinge brackets 12, 14. In the illustrated embodiment, a shaft 62 is connected between the walls 26, 28 of the door bracket 14, and one end of the check arm 60 is pivotally connected to the shaft 62, preferably by a bearing that is fixed against axial movement along the shaft 62. Other movable connections for accommodating motions of the check arm 60 may be provided, and the illustrated connection should not be regarded as limiting.

The check arm 60 has an engaging surface 64 with at least one detent. Two detents 66, 68 are illustrated. This engaging surface 64 is engaged with the engaging member 46, and, in particular, the roller 48 in the illustrated embodiment. The groove 52 on the roller 48 assists in maintaining the check arm 60 in engagement with the roller 48, and restricts relative movement of the check arm 60 in the axial direction of the roller 48. As will be discussed in further detail below, each detent provides a check position for the movement of the brackets 12, 14.

Figure 2:
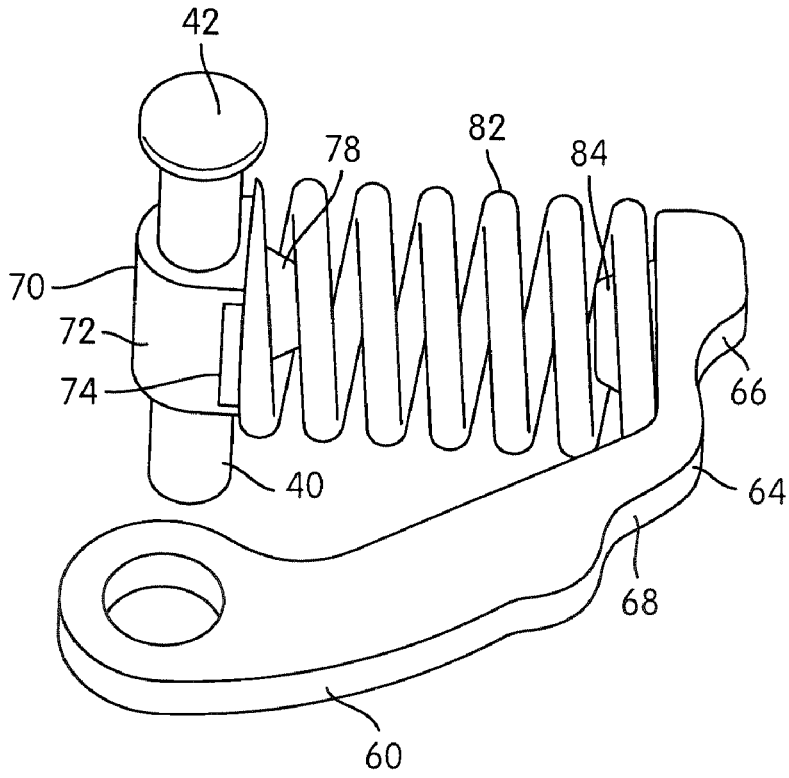
FIG. 2 shows a check arm, spring, and spring seat in isolation from the hinge of FIG. 1.
Figure 3:
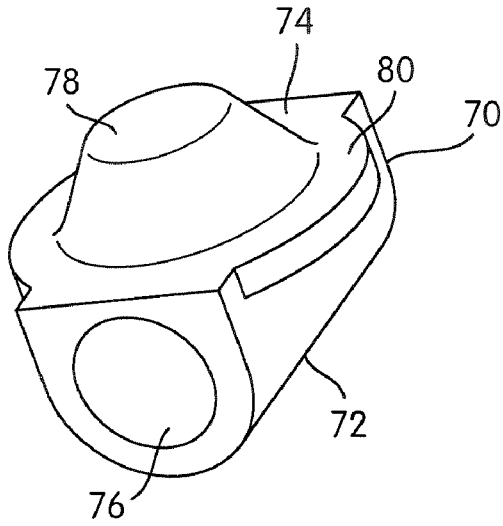
FIG. 3 shows the spring seat in isolation from a different perspective from FIG. 2.

A spring seat 70 is pivotally mounted to the hinge pin 40 between the walls of the hinge brackets 12, 14. The spring seat 70 is best seen in FIGS. 2 and 3, and comprises a mounting portion 72 and a spring seat portion 74. The mounting portion 72 has a bore 76 for receiving the hinge pin 40. The spring seat portion 74 has a projection 78 with a frustroconical configuration (i.e., like a cone with the tip cut-off), and a bearing surface 80 extending around the projection 78. The spring seat 70 may have any construction or configuration, and the illustrated example should not be regarded as limiting.

A spring 82 has one end engaging the spring seat 70 and the other end engaging the check arm 60 so as to bias the check arm 60 into engagement with the engaging member 46. The spring 82 is also located between the walls of the hinge brackets 12, 14. The illustrated example of spring 82 is a coil spring, but the spring 82 may take any construction or configuration suitable for biasing the check arm 60. In the illustrated embodiment, the end of the spring 82 engaging the spring seat 70 has the projection 78 extending into its interior, and the terminal volute (i.e., the last coil or winding) is engaged with the bearing surface 80. Likewise, the free end of the check arm 60 has a projection 84 on its side opposite the engaging surface 64. The opposite end of the spring 82 engages the check arm with the projection 84 extending into its interior and the terminal volute engaging the check arm 60 on opposing sides of the projection 84. The use of these projections 78, 84 within the interior of the spring 82 assist in securing the spring 82 in place between the spring seat 70 and the check arm 60. The illustrated spring 82 and its engagement with the check arm 60 and spring seat 70 is an example only, and should not be regarded as limiting. To the contrary, any suitable construction or mounting for the spring may be used.

As the first and second brackets 12, 14 pivot relative to one another in the opening and closing directions, the engaging member 46 and check arm 60 move relative to one another with the spring 82 biasing the check arm 60 into engagement with the engaging member 46. When the detents 66, 68 engage the engaging member 46, this provides a checked position. Specifically, the spring 82 extends slightly, and the engagement between the engaging member 46 and the respective detent 66, 68 resists relative movement between the brackets 12, 14. To move the brackets further in one direction or the other, sufficient force is applied to urge the check arm 60 against the spring 82 and disengage the respective detent 66, 68 from the engaging member 46.

During the movement of the hinge brackets 12, 14, the spring seat 70 pivots about the hinge pin 40 to accommodate a change in orientation between the check arm 60 and the door bracket 14. This is beneficial, as it allows the spring 82 to generally maintain a straighter orientation instead of experiencing too much curvature. This reduces the complex stresses associated with lateral bending of the spring, and reduces fatigue. With less fatigue, spring life may be increased, or similar spring life may be achieved with a less expensive spring.

Preferably, the spring seat 70 is molded from nylon or a suitable low friction material, and the hinge pin 40 is made of a metal, such as steel. This reduces noise between the pin 40 and the spring seat 70 (i.e., its mounting portion 72).

The illustrated embodiment has an overall advantageous design in that it has a reduced package size relative to the functionality provided. Specifically, providing the checking device (i.e., the engaging member 46, the check arm 60, and the spring seat 70) within the area between the walls of the brackets 12, 14 reduces overall size.

FIG. 1 shows the position of the hinge 10 when the door panel is in a closed position. The edge of walls 18, 20 on bracket 12 abut the flanges 30, 32 of the bracket 14 to prevent further movement of the bracket 14 in the closing direction. The opening direction is depicted by the arrow in FIG. 1. The walls 18, 20 on the body bracket 12 has stops 90, 92 provided thereon for stopping movement of the door bracket 14 in the opening direction (e.g., at 90°). These stops 90, 92 (or stop if only one is provided) in the illustrated embodiment are punched or pierced from the walls 18, 20, and are abutted by edges of walls 26, 28 when the fully open position is reached.

In the context of the illustrated embodiment, certain components have been described as being on the door bracket or the body bracket. However, the locations of these components can be reversed, and thus the illustrated embodiment is not intended to be limiting. In the claims, these brackets are referred to as a first bracket constructed to be mounted to one of the body and the panel and a second bracket constructed to be mounted to the other of the body of the panel. These terms are used to be clear that the first bracket could be either the bracket that attaches to the body or the bracket that attaches to the panel, and that the second bracket would be the other.

Any patents or applications referred to in this application, including any in the Background section, are incorporated into the present application.

The foregoing illustrated embodiment(s) has or have been provided solely for illustrating the structural and functional principles of the present invention, and should not be regarded as limiting. To the contrary, the present invention is intended to encompass all alterations, modifications, substitutions, and equivalents within the spirit and scope of the following claims.

What is claimed:

1. A hinge for connecting a panel to a body for movement between open and closed positions, the hinge comprising:

a first bracket constructed to be mounted to one of the body and the panel in an installed position of the hinge;

a second bracket constructed to be mounted to the other of the body and the panel in the installed position of the hinge;

at least one hinge pin pivotally connecting the first and second brackets;

an engaging member provided on the first bracket;

a check arm movably connected to the second bracket, the check arm having an engaging surface with at least one detent and engaged with the engaging member;

a spring seat pivotally mounted to the hinge pin; and a spring having one end engaging the spring seat and the other end engaging the check arm so as to bias the check arm into engagement with the engaging member;

wherein as the first and second brackets pivot relative to another the engaging member and check arm move relative to one another with the spring biasing the check arm into engagement with the engaging member, and wherein the spring seat pivots about the at least one hinge pin to accommodate a change in orientation between the check arm and the second bracket.

2. The hinge according to claim 1, wherein the check arm is pivotally connected to the second bracket about a check arm axis parallel to the at least one hinge pin.

3. The hinge according to claim 2, wherein the engaging member comprises a roller rotatably mounted to a shaft about a roller axis parallel to the at least one hinge pin and the check arm axis.

4. The hinge according to claim 2, wherein the engaging member is a fixed shaft mounted to the first bracket extending in a direction parallel to the at least one hinge pin and the check arm axis.

5. The hinge according to claim 1, wherein the first bracket, the second bracket, or both, is stamped from sheet metal.

6. The hinge according to claim 3, wherein the roller comprises a groove to assist in maintaining the check arm in engagement with the roller and restricts relative movement of the check arm in the axial direction on the roller.

7. The hinge according to claim 1, wherein the check arm comprises a projection extending into an interior of the spring and a region on opposing sides of the projection engaging a terminal volute of the spring.

8. The hinge according to claim 1, wherein the spring seat comprises a projection extending into an interior of the spring, a bearing surface extending around the projection engaging a terminal volute of the spring, and a bore receiving the hinge pin.

9. The hinge according to claim 8, wherein the projection is of a frustoconical configuration.

10. The hinge according to claim 1, wherein the spring seat is molded from a low friction material.

11. The hinge according to claim 10, wherein the low friction material is nylon.

12. The hinge according to claim 1, wherein the first bracket comprises at least one stop for limiting the movement of the second bracket in an opening direction.

13. The hinge according to claim 1, wherein the first bracket comprises a base having a narrow end and a wide end, and a pair of spaced apart walls extending generally perpendicularly from the base at the narrow end, each wall having a hole aligned to receive the hinge pin, the walls being higher at the narrow end and transitioning downward to a lip at the wide end.

14. The hinge according to claim 13, wherein the second bracket comprises a base and a pair of spaced apart flanges extending generally perpendicular to the base, each flange having a hole aligned to receive the hinge pin.

15. The hinge according to claim 14, wherein the second bracket further comprises a strap to provide additional structural rigidity.

16. The hinge according to claim 14, wherein the flanges of the second bracket nest within the walls of the first bracket, the respective walls of the first bracket and flanges of the second bracket being aligned to receive the hinge pin.

17. The hinge according to claim 14, wherein the base of the first bracket, the base of the second bracket, or both, comprises at least one hole for receiving mounting fasteners.

18. The hinge according to claim 1, wherein the hinge pin comprises at least two hinge pins pivotally connecting the first and second brackets.

19. A combination comprising:

a vehicle comprising a body and a panel; and a hinge for connecting the panel to the body for movement between open and closed positions, the hinge comprising:

a first bracket mounted to one of the body and the panel;

a second bracket mounted to the other of the body and the panel;

at least one hinge pin pivotally connecting the first and second brackets;

an engaging member provided on the first bracket;

a check arm movably connected to the second bracket, the check arm having an engaging surface with at least one detent and engaged with the engaging member;

a spring seat pivotally mounted to the hinge pin; and a spring having one end engaging the spring seat and the other end engaging the check arm so as to bias the check arm into engagement with the engaging member;

wherein as the first and second brackets pivot relative to another the engaging member and check arm move relative to one another with the spring biasing the check arm into engagement with the engaging member, and wherein the spring seat pivots about the at least one hinge pin to accommodate a change in orientation between the check arm and the second bracket.

20. The combination according to claim 19, wherein the check arm is pivotally connected to the second bracket about a check arm axis parallel to the at least one hinge pin.

21. The combination according to claim 20, wherein the engaging member comprises a roller rotatably mounted to a shaft about a roller axis parallel to the at least one hinge pin and the check arm axis.

22. The combination according to claim 20, wherein the engaging member is a fixed shaft mounted to the first bracket extending in a direction parallel to the at least one hinge pin and the check arm axis.

23. The combination according to claim 19, wherein the first bracket, the second bracket, or both, is stamped from sheet metal.

24. The combination according to claim 21, wherein the roller comprises a groove to assist in maintaining the check arm in engagement with the roller and restricts relative movement of the check arm in the axial direction on the roller.

25. The combination according to claim 19, wherein the check arm comprises a projection extending into an interior of the spring and a region on opposing sides of the projection engaging a terminal volute of the spring.

26. The combination according to claim 19, wherein the spring seat comprises a projection extending into an interior of the spring, a bearing surface extending around the projection engaging a terminal volute of the spring, and a bore receiving the hinge pin.

27. The hinge according to claim 26, wherein the projection is of a frustoconical configuration.

28. The combination according to claim 19, wherein the spring seat is molded from a low friction material.

29. The combination according to claim 28, wherein the low friction material is nylon.

30. The combination according to claim 19, wherein the first bracket comprises at least one stop for limiting the movement of the second bracket in an opening direction.

31. The combination according to claim 19, wherein the first bracket comprises a base having a narrow end and a wide end, and a pair of spaced apart walls extending generally perpendicularly from the base at the narrow end, each wall having a hole aligned to receive the hinge pin, the walls being higher at the narrow end and transitioning downward to a lip at the wide end.

32. The combination according to claim 31, wherein the second bracket comprises a base and a pair of spaced apart flanges extending generally perpendicular to the base, each flange having a hole aligned to receive the hinge pin.

33. The combination according to claim 32, wherein the second bracket further comprises a strap to provide additional structural rigidity.

34. The combination according to claim 32, wherein the flanges of the second bracket nest within the walls of the first bracket, the respective walls of the first bracket and flanges of the second bracket being aligned to receive the hinge pin.

35. The combination according to claim 32, wherein the base of the first bracket, the base of the second bracket, or both, comprises at least one hole for receiving mounting fasteners.

36. The combination according to claim 19, wherein the hinge pin comprises at least two hinge pins pivotally connecting the first and second brackets.

* * * * *